US006897779B2

(12) United States Patent
Nishitani et al.

(10) Patent No.: US 6,897,779 B2
(45) Date of Patent: May 24, 2005

(54) TONE GENERATION CONTROLLING SYSTEM

(75) Inventors: Yoshiki Nishitani, Hamakita (JP); Satoshi Usa, Hamamatsu (JP); Eiko Kobayashi, Hamakita (JP); Akira Miki, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 105 days.

(21) Appl. No.: 10/082,002

(22) Filed: Feb. 22, 2002

(65) Prior Publication Data

US 2002/0126014 A1 Sep. 12, 2002

(30) Foreign Application Priority Data

Feb. 23, 2001 (JP) ..... 2001-049070

(51) Int. Cl.[7] ..... G08B 23/00

(52) U.S. Cl. ..... 340/573.1; 84/600; 340/384.3; 340/384.7

(58) Field of Search ..... 340/573.1, 384.7, 340/540, 384.3; 84/600, 658, 718

(56) References Cited

U.S. PATENT DOCUMENTS 5,027,688 A * 7/1991 Suzuki et al. ..... 84/600
5,117,730 A 6/1992 Yamauchi
5,125,313 A * 6/1992 Hiyoshi et al. ..... 84/600
5,151,553 A * 9/1992 Suzuki et al. ..... 84/600
5,170,002 A * 12/1992 Suzuki et al. ..... 84/600
5,338,891 A * 8/1994 Masubuchi et al. ..... 84/600
5,541,358 A * 7/1996 Wheaton et al. ..... 84/658 X
5,585,584 A * 12/1996 Usa ..... 84/600
5,648,626 A 7/1997 Okamoto
5,661,253 A 8/1997 Aoki
5,875,257 A 2/1999 Marrin et al.

FOREIGN PATENT DOCUMENTS

| | | |
|---|---|---|
| EP | 0264782 | 10/1987 |
| EP | 1130570 | 1/2001 |
| EP | 1195742 | 4/2002 |
| GB | 2071389 | 1/1980 |
| JP | 3048892 | 3/1991 |
| JP | 9281963 | 10/1997 |

OTHER PUBLICATIONS

UK search/examination report dated Sep. 9, 2002 re Application No. GB 0204120.0.
U.S. Appl. No. 09/758,632 (copy enclosed).

* cited by examiner

*Primary Examiner*—Thomas J Mullen, Jr.
(74) *Attorney, Agent, or Firm*—Pillsbury Winthrop LLP

(57) ABSTRACT

A tone generating system 100 has a motion detection terminal 11 and a tone producing device. The Motion detection terminal 11 has a motion sensor MS which is attached to the back of a hand, and transmitting unit 11*a*. The Motion sensor MS detects a torsional motion of the hand to which it is attached. The Transmitting unit 11*a* transmits motion information on the torsional motion. A Tone producing device 10 receives the motion information, generates control information based on the motion information, and produces a tone on the basis of the control information.

20 Claims, 9 Drawing Sheets

*FIG. 5*

48: PARAMETER TABLE

| HAND SLOPE | | PARAMETER | | |
|---|---|---|---|---|
| SLOPE (X-AXIS) | SLOPE (Y-AXIS) | TIMBRE | PITCH | ... |
| 0~15° | 0~15° | TIMBRE A | C | ... |
| 0~15° | 15° ~30° | TIMBRE B | C | ... |
| 0~15° | 30° ~45° | TIMBRE A | D | ... |
| 0~15° | 45° ~60° | TIMBRE B | D | ... |
| ..... | ..... | ..... | ..... | ..... |

TONE GENERATION CONTROLLING SYSTEM

FIELD OF THE INVENTION

The present invention relates to a system for controlling tones to be generated in response to human body movements.

DESCRIPTION OF THE RELATED ART

A system is known wherein sensors attached to a human body detect a motion of that part of the body to which they are attached, and on the basis of a characteristic of a movement of that body part, a particular tone is generated. In this related system, each of various body movements is assigned different parameters, whereby a particular tone is generated by the movement of a particular part of the body. Such parameters may be used to control, for example, pitch, timbre, volume, effect, and so on. By using such a system, a user is able to use his/her body as a virtual instrument. Movement of an arm or leg, for example, or a variety of combinations of various movements of some parts of the body results in the generation of different musical tones, or different modifications of attributes of musical tones.

However, a problem of the system of the related art is that it is neither sufficiently accurate nor sensitive to enable a subtle range of control of tones generated. Specifically, in the prior art, body movements detected by sensors are limited to a relatively small number of patterns, with tones or effects generated by such movements being controlled by relatively simple parameters. Typical movement patterns could include the raising of a user's arm or leg, or the user joining together or moving apart his or her hands or legs. Due to these limitations, using the system of the related art it is difficult to produce music which is complicated, or sophisticated or subtle in effect. One possible way to increase a number of tones or tone effects generated in response to body movement would be to increase a number of sensors attached to a user's body. However, the more sensors that are attached to a user's body, the more parts of the user's body the user must move to produce musical tones or effects. The result is a system which while allowing the generation of more complex music does so at the expense of both convenience and ease of use.

SUMMARY OF THE INVENTION

In view of the problems and limitations of the related art outlined above, it is an object of the present invention to provide a tone control virtual instrument system which is both easy to use and able to produce complicated and sophisticated music. More specifically, it is an object of the present invention to provide a system by which it is possible to produce such music by the use of hand movements.

To this end, the present inventors have concentrated their efforts on developing a tone control virtual instrument system which utilizes hand movements. The reason for using a hand as an instrument of movement in such a system is that a hand can be moved with relative ease and flexibility within three dimensions, and is less vulnerable to tiredness or strain, than, for example, an arm.

A tone control system of the present invention comprises a detection terminal and a tone producing device.
The detection terminal comprises a detection unit for detecting torsional motion of a hand; and a transmitting unit for transmitting information on the torsional motion. The tone producing device receives the information sent by the detection unit, generates control information for controlling generation of tone based on the information, and produces a tone on the basis of the control information. The detection unit is preferably used by being attached to a user's hand. In a preferred embodiment, the detection terminal is used by being gripped.

In the tone control system of the present invention, a torsional motion which takes place in three dimensions, and which is complicated can be detected and translated into a particular musical tone or musical tone quality.

Furthermore, it is possible to control such attributes of tone as volume and dynamics generated by an actual instrument being played by detecting, via sensors attached to a performer's hand(s), an arrangement of the instrument. In this way, tone attributes can be controlled by a performer synchronously with playing the instrument. Specifically, a tone control system of the present invention comprises a detection unit for detecting an arrangement an actual musical instrument being played, a generation unit for generating control information for controlling a tone; and production unit for producing a tone on the basis of generated control information.

In the tone control system of the present invention, tone attributes of an actual musical instrument being played can be controlled on the basis of an arrangement of the musical instrument. Thus, a user while playing an instrument can easily change tone attributes of the instrument by changing the angle of inclination of the instrument along a vertical or horizontal plane.

BRIEF DESCRIPTION OF THE DRAWINGS

FIG. 5 shows contents of a parameter determination table.

DETAILED DESCRIPTION

Embodiments of the present invention will now be described in detail referring to the figures.

A. First Embodiment

A-1. Configuration

Figure 1:
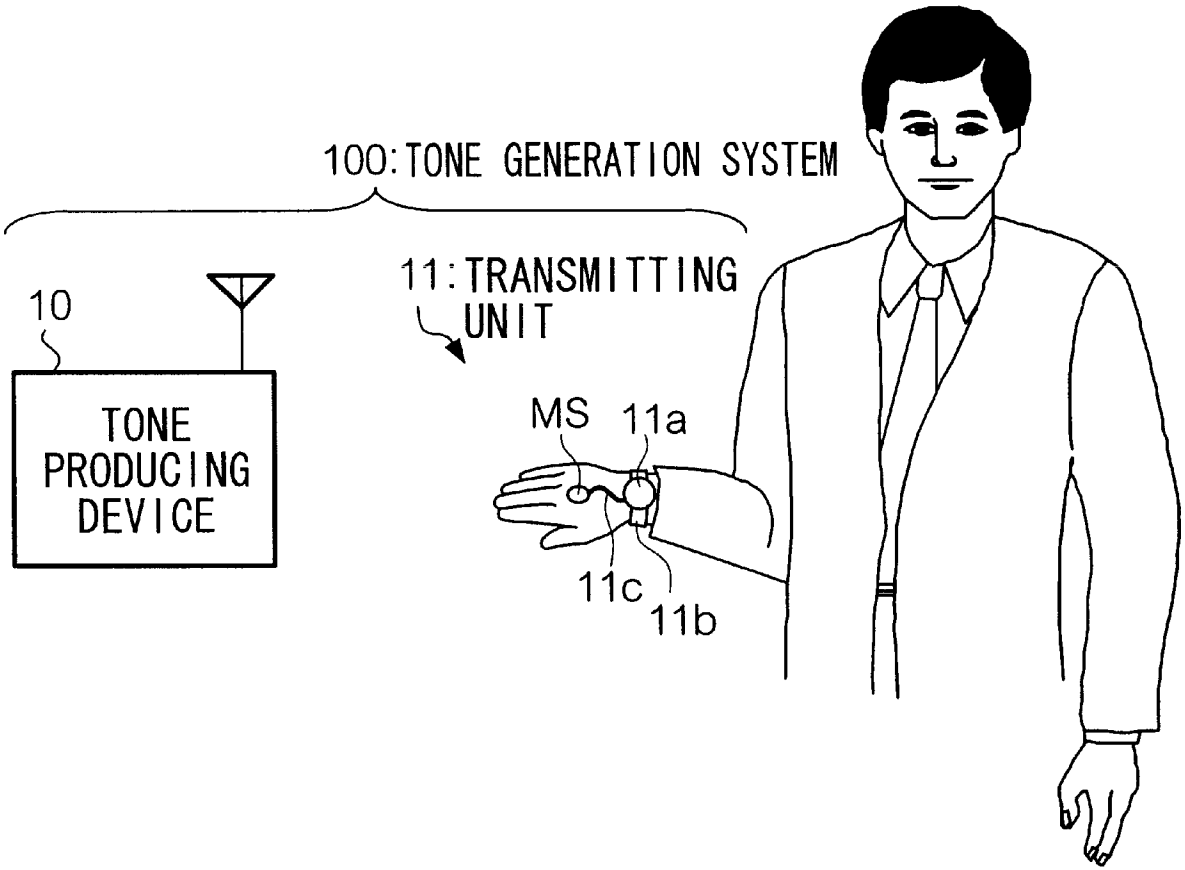
FIG. 1 shows an outline of a tone producing system based on the first embodiment.

FIG. 1 is an external perspective view of a tone generation system. As shown, a tone generation system 100 has a tone producing device 10; and a motion detection terminal 11 to be attached to a user's hand. The Motion detection terminal 11 is composed of a sensor unit MS attached to the back of a user's hand; and a transmitting unit 11*a* for transmitting to the Tone producing device 10, by radio, motion information detected by the sensor unit MS. Since The Transmitting unit 11*a* is not attached to a hand, a device to be attached to the back of a hand can be kept both compact and light, thereby enabling a user to execute hand movements with both agility and flexibility. In one example, the Transmitting unit 11*a* is attached to a user's wrist by means of a band 11*b* shown in FIG. 1. The Motion sensor MS is connected to the Transmitting unit 11*a* via a signal line 11*c*. A signal representing a hand motion detected by the Motion sensor MS is supplied to the Transmitting unit 11*a* via the Signal line 11*c*. Transmitting unit 11*a* transmits the signal to Tone producing device 10.

When a user moves his or her hand, for example, by twisting it, the Motion sensor MS detects the torsional motion, and information on the motion is transmitted from Transmitting unit 11*a* to Tone producing device 10 by radio. In this way, Tone producing device 10 is able to produce a tone in response to the motion detected by the Motion sensor MS attached to the back of the user's hand, that is, the hand movements.

Figure 2:
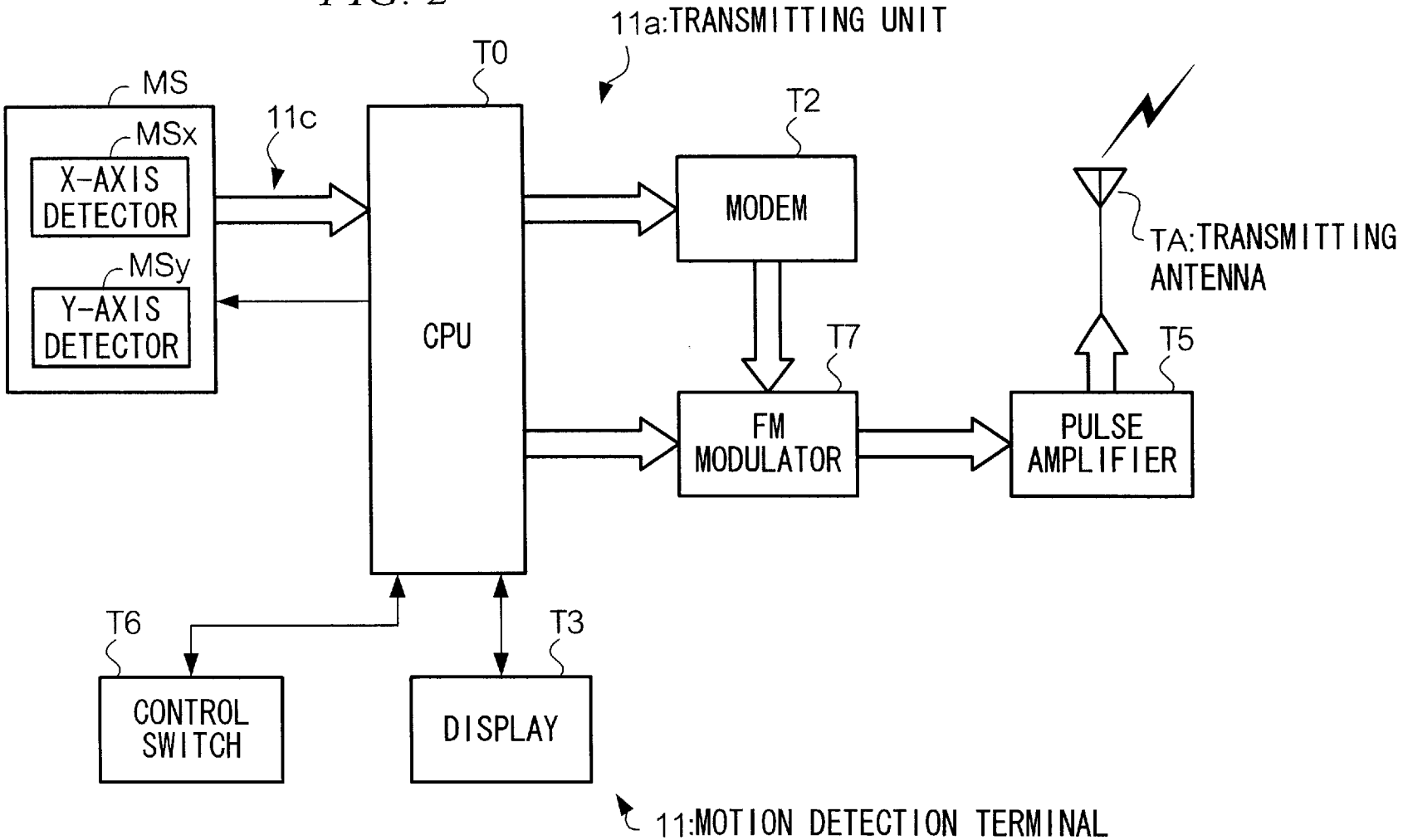
FIG. 2 is a block diagram of a motion detection terminal.

FIG. 2 is a block diagram showing a configuration of the Motion detection terminal 11. Motion detection terminal 11 comprises a Motion sensor MS, a CPU (Central processing unit) T0, a Modem T2, an FM (Frequency modulation) modulator T7,a Display T3, a Power amplifier T5, a Control switch T6, and a transmitting antenna TA.

The Motion sensor MS includes detectors MSx and MSy, which detect a motion in a direction of an X-axis and a Y-axis, respectively. In this way, bi-directional motion in three dimensions can be detected. As MSx and MSy detectors, a slope sensor, gravity sensor, earth magnetism sensor, acceleration sensor, angle sensor, or other suitable sensor can be used.

In this embodiment, a slope sensor is utilized to detect inclination of the back of a hand in the two directions. One is a direction of rolling motion of a hand (rotation around the arm, hereinafter referred to as "X-axis direction"). Another is a direction of tilting motion (vertical rotation, hereinafter referred to as "Y-axis direction")

To be more specific, each of the detectors Msx and Msy outputs a signal including the value of θx and θy. Herein, θx and θy represent angles in the following coordinate system. That is, an arbitrary point within the plane of hand is chosen as the origin. X-axis lies within the horizontal plane passing through the origin and is directed for example from the South Pole toward the North Pole. Y-axis lies within a horizontal plane and is orthogonal to X-axis passing through the origin. Z-axis is a vertical line. θx is defined as an angle between the plane of hand and X-axis plane and θy is defined as an angle between the plane of hand and Y-axis. For example, in a case where the back of the hand faces right above shown in FIG. 1 both the value of θx and θy are zero degree. It should be noted that X-axis can be chosen arbitrary within a horizontal plane but is preferably chosen by a user.

Information on a detected motion is transmitted to a CPU T0 via a Signal line 11*c*. The CPU T0 controls the Motion sensor MS, the Modem T2, the Display T3, and the FM modulator T7 via computer program stored in a memory of transmitting unit 11*a* (not shown).

Specifically, a signal sent from the Motion sensor MS is carried out a predetermined processing by the CPU T0 such as adding an ID number, and is then transmitted to the Modem T2 to be modulated by a predetermined modulation technique, for example GMSK (Gaussian Filtered Minimum Shift Keying). After the signal is carried out a frequency modulation by the FM modulator T7, it is transmitted to Power amplifier T5 to be amplified. Finally, the signal is transmitted by radio via the Transmitting antenna TA to the Tone producing device 10.

The Display T3 is, for example, a 7-segment LED (Light Emitting Diode) or an LCD (Liquid Crystal Display) for displaying information about ID numbers of the sensors, information on operational status and other related information. The Control switch T6 is provided for turning on/off the Motion detection terminal 11 and changing settings for parameters (described later). All units in the Motion detection terminal 11 are powered by a power supply (not shown). Either a primary battery or a rechargeable secondary battery can be used.

Figure 3:
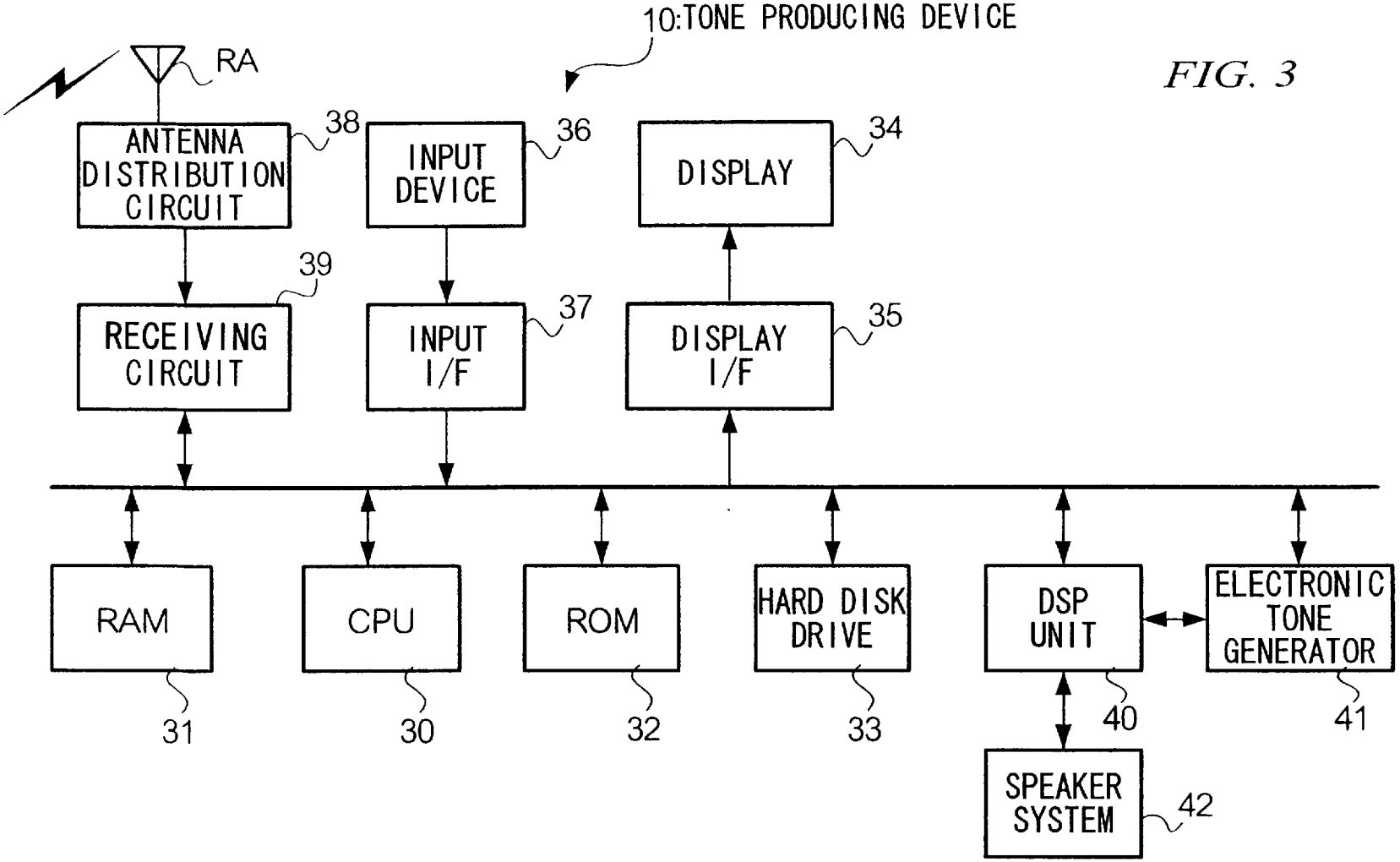
FIG. 3 is a block diagram showing hardware components of a tone producing device.

A configuration of the Tone producing device 10 will now be described referring to FIG. 3. As shown, the Tone producing device 10 has a CPU 30, a RAM (Random Access Memory) 31, a ROM (Read Only Memory) 32, a Hard disk drive 33, a Display 34, a Display interface 35, an Input device 36, an Input interface 37, an Antenna RA, an Antenna distribution circuit 38, a Receiving circuit 39, a Tone generating circuit 41, a DSP (Digital Signal Processing) unit 40, and a Speaker system 42. CPU 30 controls all units in Tone producing device 10, and carries out numerical processing. The RAM 31 functions as a working memory of the CPU 30. The ROM 32 is used to store computer programs which the CPU 30 reads and executes. The Hard disk drive 33 stores MIDI (Musical Instrument Digital Interface) data as well as computer programs to be read and executed by the CPU 30 for controlling various units. The Display 34 is, for example, a CRT (Cathode Ray Tube) or an LCD (Liquid Crystal Display) used for displaying images corresponding to image data sent from the CPU 30 via the Display interface 35. The Input device 36 is, for example, a keyboard or a mouse operated by a user. The Input interface 37 supplies data representative of any instruction inputted with the Input terminal 36 to the CPU30. The Antenna distribution circuit 38 receives a signal sent from the Transmitting unit 11*a* of the Motion detection terminal 11 (referring to FIGS. 1 and 2) via the Antenna RA. The Receiving circuit 39 converts the received signal into data which can be processed by the CPU30. The Tone generating circuit 41 generates a tone signal. The DSP unit 40 processes a tone signal generated by the Tone generating circuit 41 based on a processing executed in the CPU 30, to output to the Speaker system 42. The Speaker system 42 generates a tone on the basis of a tone signal received from the DSP 40. The CPU 30 executes programs for generating tones stored in The ROM 32 and the Hard disk drive 33 on the basis of an instruction inputted by a user via the Input device 36, to determine parameters described later.

Figure 4:
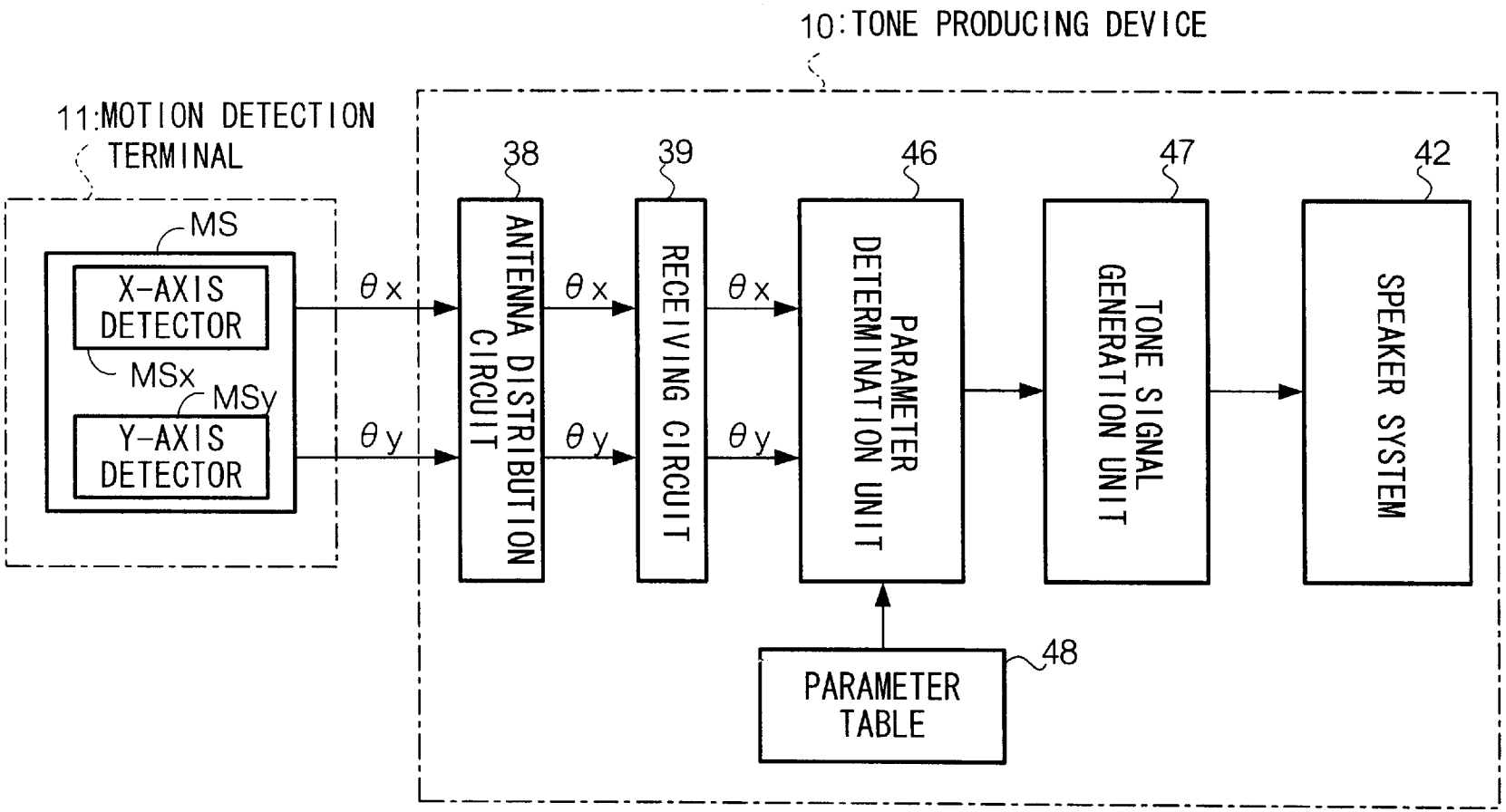
FIG. 4 is a block diagram showing functional components of the tone producing system.

Referring to FIG. 4, the function of the Tone producing device 10 will now be described. FIG. 4 is a functional diagram of the Tone producing device 10. As shown, the Tone producing device 10 has an Antenna distribution circuit 38, a Receiving circuit 39, a Parameter determination unit 46, a Tone signal generation unit 47, a Parameter table 48, and a Speaker system 42.

The Antenna distribution circuit 38 receives detection signals from an X-axis detection unit and Y-axis detection unit, each of which represents θx, inclination angle in the direction of X-axis and θy, inclination angle in the direction of Y-axis, respectively, to output to the Receiving circuit 39. At the Receiving circuit 39, a signal representing an angle of inclination of a hand in X-axis and Y-axis directions supplied from the Antenna distribution circuit 38 passes through a prescribed band pass filter (not shown) to remove unnecessary frequency components. The Receiving circuit 39 outputs the filtered signal to the Parameter determination unit 46.

Figure 6A:
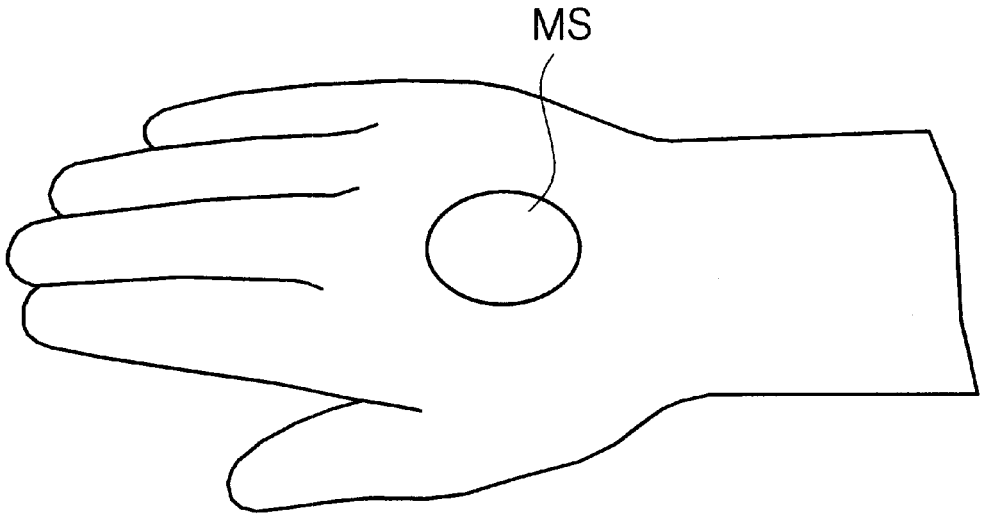
FIGS. 6A and 6B show examples of a motion of a hand.
Figure 6B:
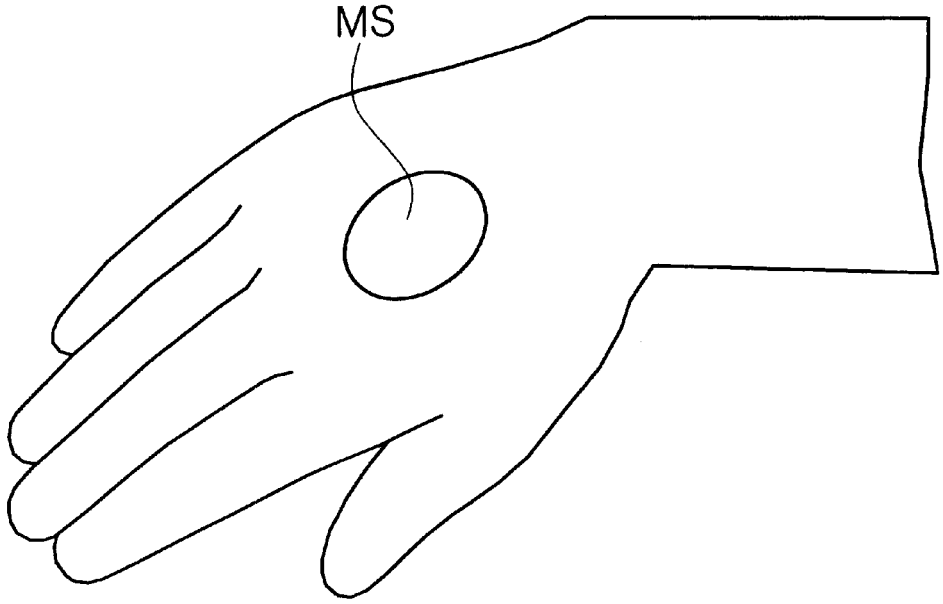

Parameter determination unit 46 determines parameters necessary to produce a particular tone, pitch, and/or quality such as timbre, volume, effect, according to θx and θy supplied from the Receiving circuit 39, by referring to Parameter table 48. Specifically, the Parameter 48 stored in the RAM 31 or the Hard disk drive 33 has values of θx and θy and corresponding parameter as shown in FIG. 5. The Parameter determination unit 46 retrieves from the Parameter table 48 a parameter corresponding to θx and θy. When a user makes a twisting movement of his or her wrist, for example, and moves their hand from a horizontal position in a downward slanting direction, as shown in FIG. 6B (FIG. 6A), the motion sensor MS detects this motion. Value of both θx and θy are "20 degrees" (equivalent to a value in the second row of the table in FIG. 5). Parameter determination unit 46 sets the parameters, for example, a timbre parameter as "timbre B", a pitch parameter as "C". Values of parameters of the Parameter table 48 may be fixed, but preferably a user can set values as desired by operating the Input device 36.

As described above, θx and θy represents inclinations of a hand. However, it often occurs that a direction to which a user wants to move and a direction detected by a sensor do not completely coincide. Specifically, when a user intends to move a hand directly upward (downward) that is, rotate a hand vertically, thereby changing only the value of θy, the hand slightly rolls (leans sideways), thus the value of θx fluctuates. On the other hand, when a user intends to rotate a hand sideways (θx is changed), the hand moves vertically a little (θy is changed). To deal with such a situation, the Parameter determination unit 46 compares θx and θy, to compensate a value of a parameter. For example if a value of θx is 10% less than a value of θy, Parameter determination unit 46 regards the value of θy as "0 degree" in determining a parameter.

It should be noted that initial values of θx and θy can be set freely. For example, the initial value of θx may be set "0 degree" when the plane of the back of a hand is vertical.

The Parameter determination unit 46 outputs the determined parameters to the Tone signal generation unit 47. The Tone signal generation unit 47 generates a tone signal corresponding to timbre information and pitch information. A tone signal generated in the Tone signal generation unit 47 is output to the Speaker system 42 to produce a tone corresponding to the tone signal, that are represented by those parameters supplied from the Parameter determination unit 46.

A-2. Method for Producing Tone

There will now be described a method for producing a tone in the tone control system of the present invention. Firstly, a user turns on the Tone producing device 10 and the Motion detection terminal 11 to execute computer programs stored therein, and which function to produce tones in the Tone producing device 10. The Motion detection terminal 11 sends a signal including the values of θx and θy to the Tone producing device 10 all the time.

When a user gives an instruction to start playing to the tone producing device 10, by for example operating the input device 36, the Parameter determination unit 46 in the tone producing device 10 starts to generate parameters necessary to generate a signal. Specifically, the Parameter determination unit 46 determines parameters such as a timbre and pitch according to the values of θx and θy included in a signal sent from the Motion detection terminal 11. Tone signal generating unit 47 generates a signal corresponding to a timbre and pitch designated by the generated parameters. When a user moves, for example, twists his or her hand to which the Motion detection terminal 11 is attached, the inclination of the back of the hand varies with time. This means that the value of θx and θy vary with time. As a result, a timbre and pitch of tone generated in the tone producing device 10 varies with time.

Assuming here that the back of hand faces right above with fingers stretched as shown in FIG. 1 and the middle finger looks toward the direction of Y-axis at first. θx and θy are 0 degree at this time. When a user bends the wrist, that is, the hand rotates upon the wrist (vertically), the plane of hand rotate within YZ-plane to a horizontal plane. Therefore, θy varies while θx remains 0 degree. That is, a timbre and pitch generated in the tone producing device 10 varies according to the amount of inclination in such a manner that a tone with timbre "A" and pitch D is generated as shown in FIG. 5 when θy is within a range from 0 through 15 degrees, so is a tone with timbre "B" and pitch C when θy is within a range from 15 through 30 degrees, and so on.

On the other hand, when a user rolls the hand upon (rotation within XZ-plane), θx varies according to the amount of rolling while θy remains 0 degree.

When the plane of hand faces another direction, generated tone varies with time in a different way. Specifically, combination of bending the wrist and rolling the hand results in a change of both θx and θy at the same time. In other words, such a continuous 'twist' motion of the hand results in generation of much more complicated tone with time.

In this way, a user is able to control in real time by using continuous hand movements, musical attributes of tone such as pitch. To put it simply, a user by continuously moving his or her hand is able to play a melody.

As described above, in this embodiment a tone which is generated according to a hand movement can be controlled. Since a human can move his or her hand the most easily and subtly among other body parts of human, a user can control generation of a tone more sophisticatedly by narrowing each range of hand movement which is corresponding to a tone (with particular pitch or timbre).

Musical instruments are played by physically manipulating a part of the instrument; for example, keys in the case of a piano or strings in the case of a guitar. However, using the system of the present invention a user is able to readily control a generated tone simply by moving a hand within a variety of dimensional positions. One of the interesting features of such a system over traditional instruments is that hand movements which are more akin to those used in dance can be used to create and manipulate tone as music.

While the system of the present invention is obviously well-suited to performance situations requiring improvisation of music, it is equally possible for the system of the present invention to be used in a more conventional manner, where a score is utilized. However, unlike a conventional music score which employs stave lines and graphical representations of musical tone as notes, in using the system of the present invention a different kind of music score can be envisaged. Such a score could consist of a graphical representation of hand movements, which a performer would execute in following a motion score composition. More specifically, such a score is described by the amount and direction of twisting of a hand on the times series.

Such a motion score could, for example, be comprised of parameters stored in the Parameter determination table 48. If a variety of parameters are stored for a music composition, a user will be able to 'play' the composition by executing composed hand motions. In other words, if parameters having variable settings are stored in the Parameter determination table 48, a user or performer will be able to play a variety of music compositions by using a variety of hand motions.

Needless to say, there are various possibilities for improving and enjoying this medium of motion score composition: parameters with variable settings can be exchanged between people and stored in multiple parameter determination tables, whereby original music compositions can be performed by following motions 'composed' by other people. Such a concept of distribution also obviously lends itself to a business model where a service provider employing the Tone producing system 100 provides a set of parameters for a parameter determination table and/or provides motion scores to users. Specifically, a service provider provides data for use in the parameter determination table to users, via a variety of storage media such as CD-ROMs (Compact Disc-Read Only Memory) or by making it downloadable over the Internet. In fact storage for both parameter data and motion score compositions in graphical form are not limited to any particular media, and can be distributed in the latter case in conventional book form, or in the case of data by any available electronic storage means.

As will be apparent, the present invention as described in the first embodiment is susceptible to various modifications, some of which are outlined in the following descriptions.

(Modification 1)

Figure 7:
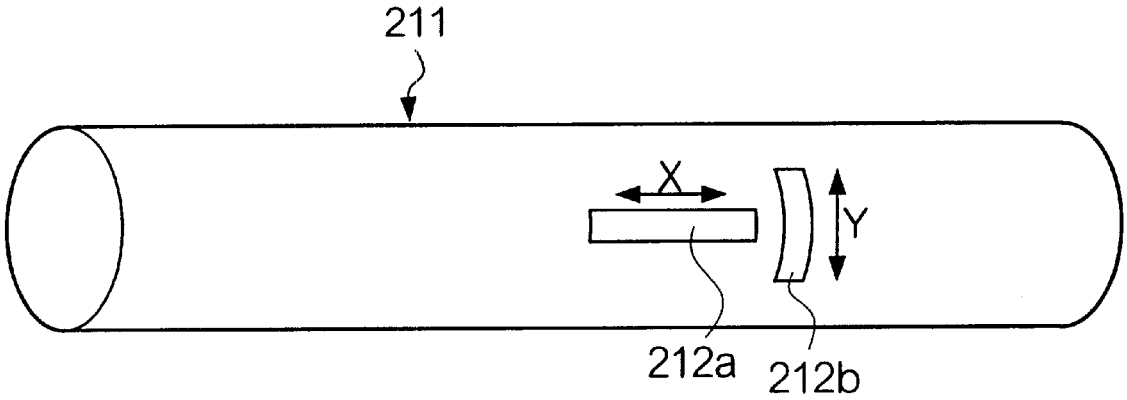
FIG. 7 is a perspective view of a motion detection terminal based on a modification of the first embodiment.
Figure 8:
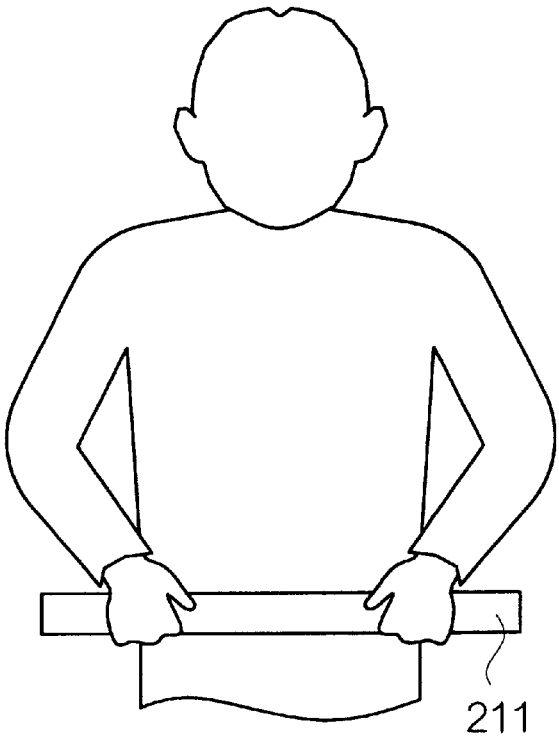
FIG. 8 shows how to use the motion detection terminal.

In the first embodiment the Motion sensor MS is attached to the back of a hand, to thereby detect torsional motion. As shown in FIG. 7, a rod-like motion detection terminal may be introduced, functioning as both the motion sensor MS and the Transmitting unit 11*a*. Specifically, a Motion detection terminal 211 shown in FIG. 7 has a cylindrical shape. The Motion detection terminal 211 is used in a predetermined manner that a user holds at both edges, as shown in FIG. 8.

As shown in FIG. 7, distortion gauges 212*a* and 212*b* are attached on the surface of the Motion detection terminal 211, to detect twisting of hands. Each gauge detects an amount of distortion of the surface of the Motion detection terminal 211 in an X-axis direction and a Y-axis direction respectively, which directions are orthogonal to each other. The Transmitting unit 11*a* is integrated in the Motion detection terminal 211, and information on distortion in X-axis and Y-axis directions, each detected by the Distortion gauge 212*a* and 212*b*, is transmitted, by radio, to the Tone producing device 10 shown in FIGS. 1 and 4.

When the Tone producing device 10 receives the information, parameters are determined by an amount of distortion in X-axis and Y-axis directions. Tone is generated corresponding to the parameters. In the system of this modification, the Motion Detection terminal 211 is used in a predetermined manner so as to detect a torsional motion, so that, similar to the first embodiment, a tone is generated depending on a twisting motion of a hand or hands.

(Modification 2)

In the first embodiment, a hand motion determines a pitch and timbre to be generated. However, it is also possible for a hand motion to govern a tempo, volume, and other parameters. In other words, tone attributes of a music composition can be controlled, such as tempo, volume, effect, and any other attribute parameters that are predetermined prior to reproduction.

Specifically, the Hard disk drive 33 stores MIDI data. Parameter determination table stores values of tempos instead of pitch or timbre; and corresponding values θx and θy, respectively. Tone producing device plays a piece of music represented by MIDI data. During the playback of the MIDI data, when a hand is in a horizontal position as shown in FIG. 6A the music is played at its normal tempo. When a user bends his or her wrist as shown in FIG. 6B, the music is played, for example, at a faster tempo. Needless to say, other parameters concerning volume and dynamics and adding effects can likewise be controlled.

(Modification 3)

Figure 9:
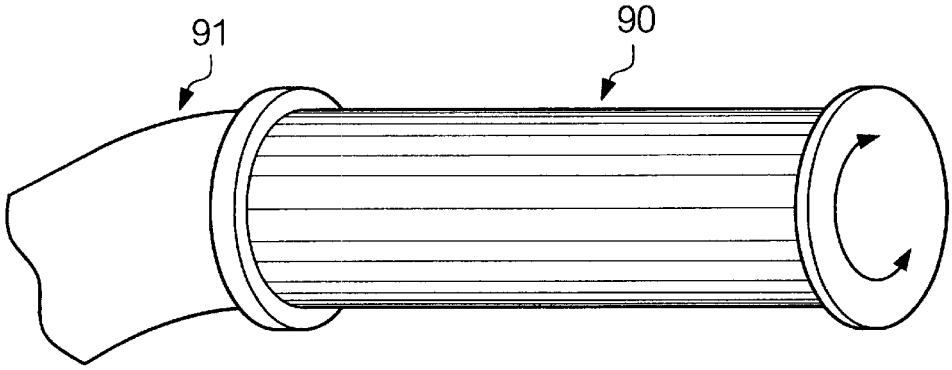
FIG. 9 is a perspective view of a motion detection terminal based on another modification of the first embodiment.

As shown in FIG. 9, it is possible for a motion detection device 91 in the form of a handlebar of a motorbike to be introduced, in place of the Motion sensor MS and the Transmitting unit 11*a*. The Motion detection device 90 has a handgrip 90*a* which is rotatable in the direction of the arrow shown in FIG. 9. A rotation sensor is embedded for detecting an amount of rotation of the handgrip 90*a* with reference to an initial position. Information on the amount of rotation detected by the rotation sensor is transmitted to the Tone producing device 10, as shown in FIGS. 1 and 4. When the Tone producing device 10 receives the information, it determines one or more parameters to generate a tone corresponding to one or more of the parameters determined.

One example of a system using the Motion detection device 90 is a motorcycle simulator. Specifically, an electronic tone generator is provided for producing a tone emulating an exhaust tone of a motorcycle. The Parameter determination table 48 stores the tone data and rotation angle values. When a user rotates the handgrip 90 by his/her hand, exhaust tones produced by the electronic tone generator change in accordance with the angle of the hand. Therefore a user hears exhaust tones which are synchronized with operation of the handgrip, thereby creating a realistic tone effect of a user riding a motorcycle.

(Modification 4)

It is possible for a plurality of users to control tone in concert. For example, the Motion sensor MS only including the MSx for detecting a motion in an X-axis direction is attached to the back of a hand of a user. Whereas a motion sensor including only MSy for detection a hand motion in a Y-axis direction is attached to the back of a hand of another user. Information about hand motion in both X-axis and Y-axis directions is transmitted to the Tone producing device 10 by radio. Similar to the first embodiment, the Tone-producing device 10 determines parameters on the basis of detected information, thereby controlling generated tone.

(Modification 5)

It is possible that the tone producing device 10 determines, at regular intervals (one second, for example), a timbre and pitch on the basis of values of θx and θy that are received the most proximately, to generate tone with the timbre and pitch during a predetermined period (0.8 second, for example). In addition, the tone producing device 10 may generate a rhythmic tone to notify a user of the timings of determination of a timbre and pitch.

(Modification 6)

It is possible that the tone producing device 10 differentiate θx and θy with respect to time, and determines a timbre and pitch on the basis of the values of θx and θy to generate a tone with the timbre and pitch if a time differential coefficient of either θx or θy is not zero. In this case, when a user's hand is standing still no tone is generated, on the other hand when a user is moving the hand, a tone is generated according to inclination of the hand.

B. Second Embodiment

Figure 10:
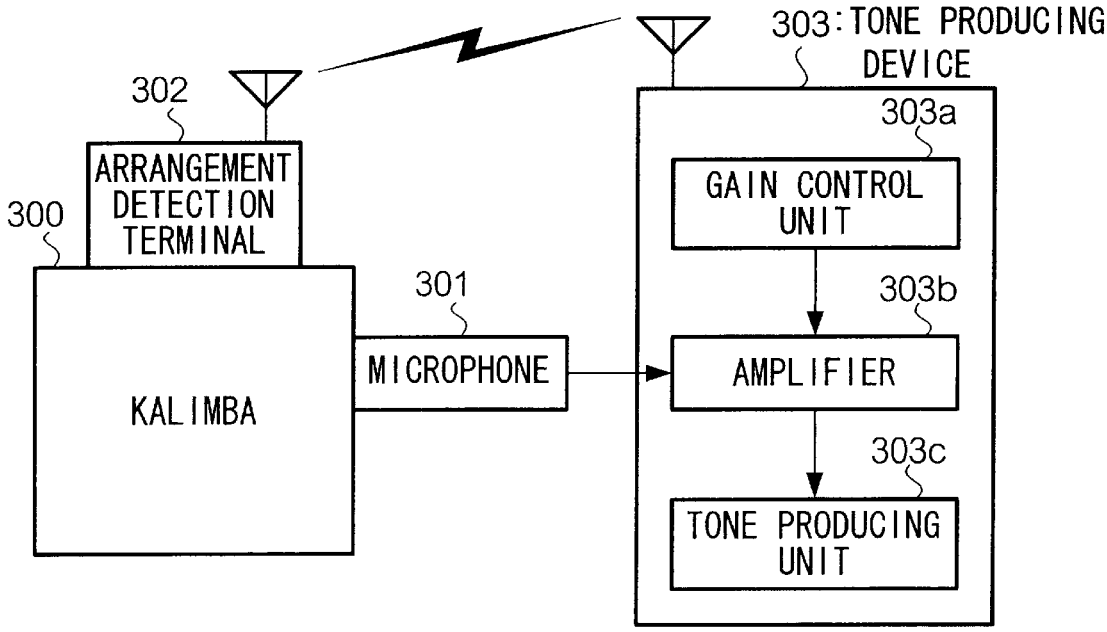
FIG. 10 shows functional components of a tone producing system based on the second embodiment.
Figure 11:
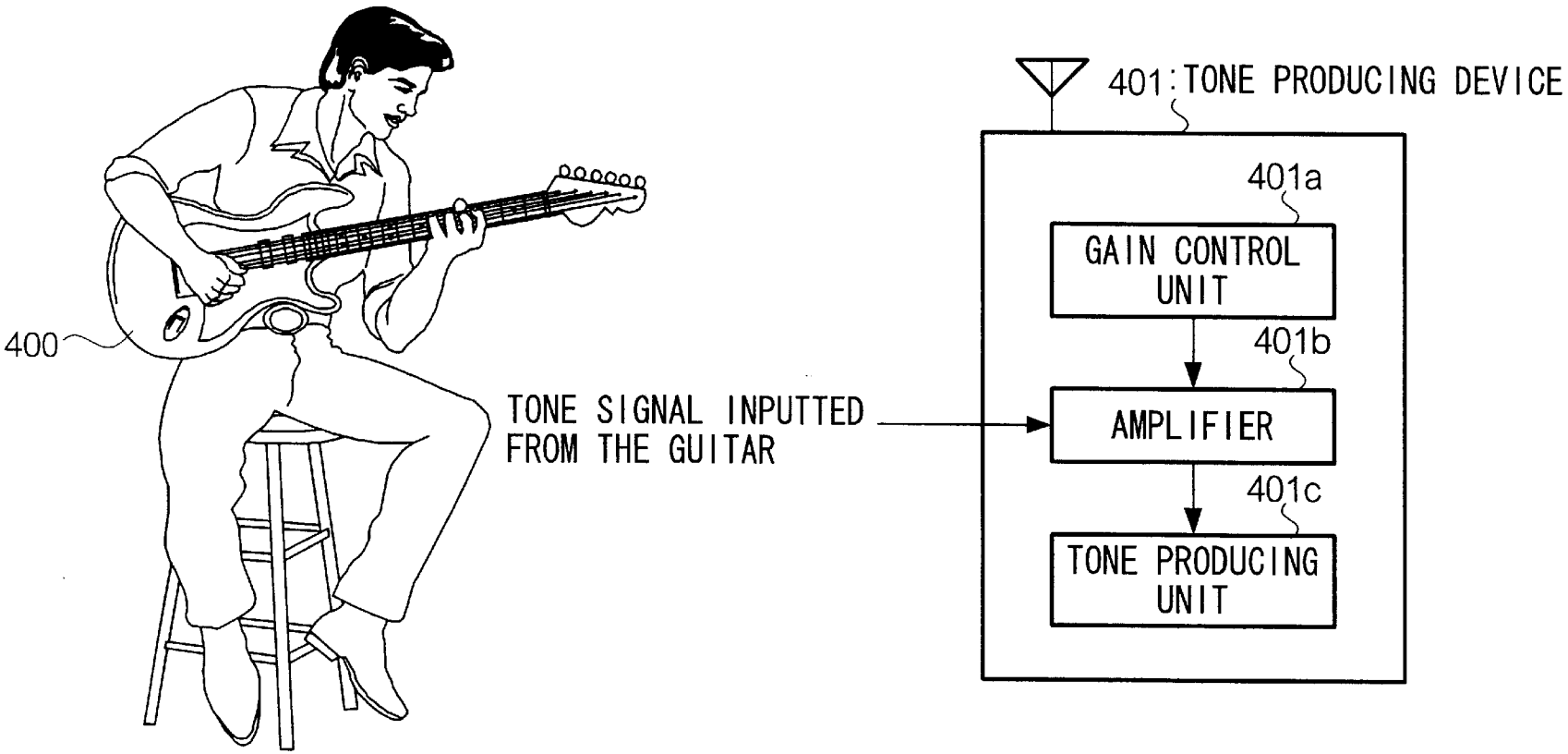
FIG. 11 shows functional components of a tone producing system based on a modification of the second embodiment.

A tone producing system based on the second embodiment will now be described. In the first embodiment Sensor MS attached to the back of a hand detects a motion of that hand. In a second embodiment a detection terminal is attached to or embedded in a musical instrument, instead of the Motion detection terminal 11 including the Motion Sensor MS and the Transmitting unit 11*a*. In this system, a tone is generated synchronously with an arrangement of the instrument. FIG. 10 shows a specific example of this system using an African instrument called a Kalimba, which is a kind of plucked idiophones and used on the African continent.

In this system, a microphone 301 and an arrangement detection terminal 302 are attached to the body of a Kalimba 300. An arrangement detection terminal 302 has an angle sensor for detecting an inclination angle of the Kalimba and a transmitting unit which has the same function of the Transmitting unit 11*a*. The Microphone 301 picks up a tone generated by playing the Kalimba 300 and outputs the tone signal to a Tone producing device 303. Each inclination sensor detects inclination of the instrument in an X-axis (horizontal) and a Y-axis (vertical), respectively, regarding a horizontal position of the Kalimba 300 as initial state. The transmitting unit transmits, by radio, detected information on inclination to a tone producing device 303. The Tone producing device 303 has a gain control unit 303*a,* an amplifier 303*b,* and a tone producing unit 303*c*. The Gain control unit 303*a* receives inclination information transmitted by the Arrangement detection terminal 302 and determines an amplification rate by the information, so as to output to the Amplifier 303*b*. The Amplifier 303*b* has a digital multiplier that amplifies a tone signal at the amplification rate determined by the Gain control unit 303*a*. An amplified signal is outputted to the Amplifier 303*b*. The Tone producing unit 303*c* has a speaker that decodes a signal amplified by the Gain control unit 303*b* to produce a tone at a volume level, which is controlled in accordance with the inclination of the Kalimba 300.

In this system, when a user inclines the Kalimba 300 while playing it, a tone of Kalimba generated in the Tone producing unit 303*c* varies. Specifically, the Gain control unit 303*a* determines a volume of a tone to be generated depending on an angle of inclination of the instrument. Consequently, the greater the angle of inclination of the Kalimba 300 in either a horizontal or vertical direction, the louder a tone produced. As described above, a user is able to control generation of tones such as volume control easily and smoothly by simply inclining a musical instrument, without interference with the play.

Other instruments are suited for use in this system. FIG. 1 shows an example of a system in which a guitar 400 is provided. A tone producing device 401 communicates with the Microphone 301 and Arrangement detection terminal 302 which are attached to the Guitar 400.

The Tone producing device 401 has a Gain control unit 401*a,* an Amplifier 401*b,* and a Tone producing unit 401*c*. When the Gain control unit 401*a* receives information on inclination of the guitar sent from the Arrangement detection terminal 302, the Gain control unit 40 determines an amplification rate, and outputs the rate to the Amplifier 401*b*. The Amplifier 401*b* amplifies a tone signal picked up by the microphone, at the rate determined by the Gain control unit 401*a*. An amplified signal is outputted to the Tone producing unit 401*c*. The Tone producing unit 401*c* decodes the signal to produce a tone. In this way, The Tone producing device 401 generates musical tone at a volume level corresponding to the angle of inclination of the guitar. In other words, a user controls a volume level of the musical tone by changing an angle of inclination of the guitar.

In other words, by using the system of the present invention, just as it is possible for a user to control a volume of a tone using an attitude or position of a hand as a virtual instrument tone attribute control, so is it possible for a tone of an actual instrument to be modified by using the same principle of arrangement or position control. In other words, a simple movement such as changing an angle of inclination of an instrument is effective for controlling, for example, the volume of the instrument. In this way it is possible for a performer to easily control tone attributes generated by an instrument, such as volume or dynamics, without suffering any interference in playing the instrument. Another option is to introduce an external tone generator which has the same function as the tone producing device 303. In addition, the external tone generator stores and play music data (such as MIDI data), and to control compositional attributes such as tone pitch, length and so on, by simply changing an arrangement of inclination of an instrument. Specifically, a user plays the Guitar 400 while the external tone generator plays a tune. When a user inclines Guitar 400, parameters such as a volume and tempo of tone generated at the external tone source changes corresponding to an amount of inclination.

Using this system, a user is able to play music having an ensemble character, utilizing both the guitar and the external tone generator. For example, a user inclines, in a predetermined way, the Guitar 400, and in response the external tone source plays a piano tone at a high volume. Thus, the user is able to orchestrate music by producing different tone attributes in an external tone generator which augment and compliment tones of an actual instrument being played.

In a system based on the second embodiment, an inclination sensor is used for detecting an arrangement of an instrument. However, it is possible to use an earth magnetism sensor, gravity sensor, or other suitable sensors to effect detection. Also, a tone attribute to be controlled is not limited to volume, and parameters could be assigned to a variety of attributes. For example, the Tone producing device 303 or 401 may have a unit for determining a timbre or changing a timbre corresponding to an arrangement of the instrument. Preferably, setting a volume level at the gain control units 303*a* or 401 can be effected as desired by a user.

Although the foregoing description provides many variations for use of the present invention, these enabling details should not be construed as limiting in any way the scope of the invention, and it will be readily understood that the present invention is susceptible to many modifications, and equivalent implementations without departing from this scope and without diminishing its attendant advantages.

What is claimed is:

1. A tone generation controlling system comprising:

a detector that detects an arrangement state of a musical instrument;

an information generator that generates, on the basis of the detected arrangement state of the musical instrument, control information for controlling a tone; and a tone generator that picks up a tone generated by the musical instrument, converts the tone into a tone signal, and controls the tone signal on the basis of the generated control information, to thereby generate a tone on the basis of the controlled tone signal.

2. A tone signal generator adapted for a tone generation controlling system, said system including said tone signal generator and a terminal, said tone signal generator comprising:

a receiver that receives a plurality of motion parameters which are detected by said terminal, each of the plurality of motion parameters corresponding to an axial component of torsional hand motion of a user of said terminal;

a determining unit that determines a tone parameter on the basis of a combination of the plurality of motion parameters; and a tone generator that generates a tone signal on the basis of the determined tone parameter.

3. The tone signal generator of claim 2, wherein the tone parameter represents any of pitch, timbre, timing, effect, tempo, and volume.

4. The tone signal generator of claim 2, wherein said terminal is used by being attached to a user's back of hand or being held by the user.

5. The tone signal generator of claim 2, wherein:

the plurality of motion parameters are obtained by an inclination sensor provided at said terminal; and each the plurality of motion parameters corresponds to an axial component of inclination of the user's hand.

6. The tone signal generator of claim 2, wherein:

the plurality of motion parameters are obtained by a distortion gauge provided at said terminal; and each of the plurality of motion parameters corresponds to an axial component of distortion of said terminal.

7. The tone signal generator of claim 2, wherein the tone parameter is determined referring to a table, in which the plurality of motion parameters and the tone parameter are stored, correspondingly.

8. The tone signal generator of claim 2, wherein the tone parameter and the plurality of motion parameters stored in a table can be changed by the user.

9. A terminal adapted for a tone generation controlling system, said system including a tone generator and a terminal, said terminal comprising:

a detector that obtains a plurality of motion parameters, said detector attached to the back of a user's hand, and each of the plurality of motion parameters corresponding to an axial component of torsional hand motion of a user of said terminal;

a transmitter that transmits the plurality of motion parameters to said tone generator, to thereby generate a tone signal on the basis of a combination of the plurality of motion parameters.

10. A terminal adapted for a tone generation controlling system, said system including said terminal and a tone generator, said terminal comprising:

a displacement unit to be held by a user of said terminal, said displacement unit being capable of being torsionally displaced;

an obtaining unit that obtains displacement information on a plurality of strain parameters, each of which corresponds to an axial component of displacement of said terminal; and a transmitter that transmits the displacement information to said tone generator, to thereby generate a tone signal on the basis of the information.

11. A terminal adapted for a tone generation controlling system, said system including said terminal and a tone generator, said terminal comprising:

an internal fixed unit;

an external handlebar to be gripped by a user of said terminal, said external handlebar being provided outside said internal fixed unit, and said handlebar being capable of rotating about said internal fixed unit;

a detector that obtains rotational motion information showing an amount of rotational motion of said handlebar; and a transmitter that transmits the rotational motion information to said tone generator, to thereby generate a tone signal on the basis of the information.

12. A detecting device comprising:

an inclination sensor that obtains information on inclination of a musical instrument, the sensor being attached to the musical instrument, the information including a plurality of inclination parameters, each of which corresponds to an axial component of the inclination of the musical instrument; and a transmitter that transmits the inclination information to a tone generator that generates a tone according to a user's performance of the musical instrument, to thereby control the tone generated by the tone generator on the basis of the inclination information.

13. A tone generator comprising:

a generator that generates a tone of a musical instrument played by a user;

a receiver that receives inclination information on the musical instrument, the inclination information including a plurality of inclination parameters, each of which corresponds to an axial component of the inclination of the musical instrument, the inclination information transmitted by a detecting device attached to the musical instrument; and a controller that controls a tone on the basis of the received inclination information.

14. The tone generator of claim 13, wherein said controller controls an amplification factor or tempo, which are used in said generator, on the basis of the inclination information.

15. A method for generating a tone in a tone generation controlling system, said system including a tone generator and a terminal, the method comprising the steps of:

receiving, in said tone generator, a plurality of motion parameters which are detected by said terminal, each of the plurality of motion parameters corresponding to an axial component of torsional hand motion of a user of said terminal;

determining, in said tone generator, a tone parameter on the basis of a combination of the plurality of motion parameters; and generating, in said tone generator, a tone signal on the basis of the determined tone parameter.

16. A method for obtaining information for generating a tone in a tone generation controlling system, said system including a tone generator and a terminal, the method comprising the steps of:

obtaining, in said terminal, a plurality of motion parameters from a detecting device, the device attached to the back of the users hand, and each of the plurality of motion parameters corresponding an axial component of the torsional hand motion of a user of said terminal; and transmitting the plurality of motion parameters from said terminal to said tone generator, to thereby generate a tone on the basis of a combination of the plurality of the motion parameters.

17. A method for obtaining information for generating a tone in a generation controlling system, said system including a terminal and a tone generator, the method comprising the steps of:

obtaining, in said terminal, displacement information on a plurality of strain parameters, each of which corresponds to an axial component of displacement of a displacement unit provided at said terminal, the displacement unit being capable of being torsionally displaced, and the displacement unit held by a user of the terminal; and transmitting the displacement information from said terminal to said tone generator, to thereby generate a tone signal on the basis of the information.

18. A method for obtaining information for generating a tone in a tone generation controlling system, said system including a terminal and a tone generator, the method comprising the steps of:

obtaining, in said terminal, rotational motion information showing an amount of rotational motion of a handlebar, the handlebar being provided outside an internal fixed unit, and the handlebar being capable of rotating about said internal fixed unit; and transmitting the rotational motion information from said terminal to said tone generator, to thereby generate a tone signal on the basis of the information.

19. A method for obtaining information for controlling a tone of a musical instrument, the method comprising the steps of:

obtaining, by a sensor provided at a terminal, information on inclination of the musical instrument, the sensor being attached to the musical instrument, the information including a plurality of inclination parameters, each of which corresponds to an axial component of the inclination; and transmitting the information from said terminal to a tone generator that generates a tone according to a user's performance of the musical instrument, to thereby control a tone on the basis of the information.

20. A method for controlling a tone by a tone generator, according to a user's performance of a musical instrument, the method comprising the steps of:

generating a tone according to a user's performance of the musical instrument;

receiving, from a detecting device attached to the musical instrument, information on inclination of the musical instrument, the information including a plurality of inclination parameters, each of which corresponds to an axial component of the inclination; and controlling a tone on the basis of the received information.

* * * * *